United States Patent [19]

Moldrup

[11] Patent Number: 4,542,046

[45] Date of Patent: Sep. 17, 1985

[54] IMPREGNATION TANK FOR WOOD

[76] Inventor: Niels Moldrup, 9 Rytterhegnet, 3450 Allerod, Denmark

[21] Appl. No.: 394,027

[22] Filed: Jun. 29, 1982

Related U.S. Application Data

[63] Continuation-in-part of Ser. No. 192,383, May 2, 1980, abandoned.

[51] Int. Cl.[4] ..... B05D 3/00; B27K 3/08

[52] U.S. Cl. ..... 427/298; 427/346; 427/441; 118/50; 118/56

[58] Field of Search ..... 427/297, 298, 441, 430.1, 427/346; 118/50, 426, 416, 503, 56; 134/186, 194

[56] References Cited

U.S. PATENT DOCUMENTS

| | | | |
|---|---|---|---|
| 553,547 | 1/1896 | Tyler, Jr. | 118/426 X |
| 662,104 | 11/1900 | Stern et al. | 118/50 |
| 695,152 | 3/1902 | Higgins | 118/50 |
| 970,509 | 9/1910 | Ketchenson et al. | 118/50 |
| 2,457,070 | 12/1948 | Scharwath | 118/426 X |

FOREIGN PATENT DOCUMENTS

| | | | |
|---|---|---|---|
| 2015601 | 9/1979 | United Kingdom . | |
| 350651 | 9/1972 | U.S.S.R. | 118/50 |

*Primary Examiner*—John P. McIntosh
*Attorney, Agent, or Firm*—Ladas & Parry

[57] ABSTRACT

The apparatus and the method for impregnation of wood. The apparatus has a closable tank which defines our interior space and comprises a vessel with at least one door for closing the vessel to isolate the interior space from the exterior of the tank. The tank being capable of supporting a pressure difference between the interior space and the exterior of the tank. The apparatus contains a device for supplying liquid to and receiving from the interior space of the tank, a device for establishing a pressure difference between the interior space and the exterior of the tank, a structure which is disposed in the interior space for holding wood to be treated and a structure supporting the holding structure to permit rotation of the holding structure about a non-vertical axis while holding wood to be treated.

6 Claims, 2 Drawing Figures

IMPREGNATION TANK FOR WOOD

Figure 1:
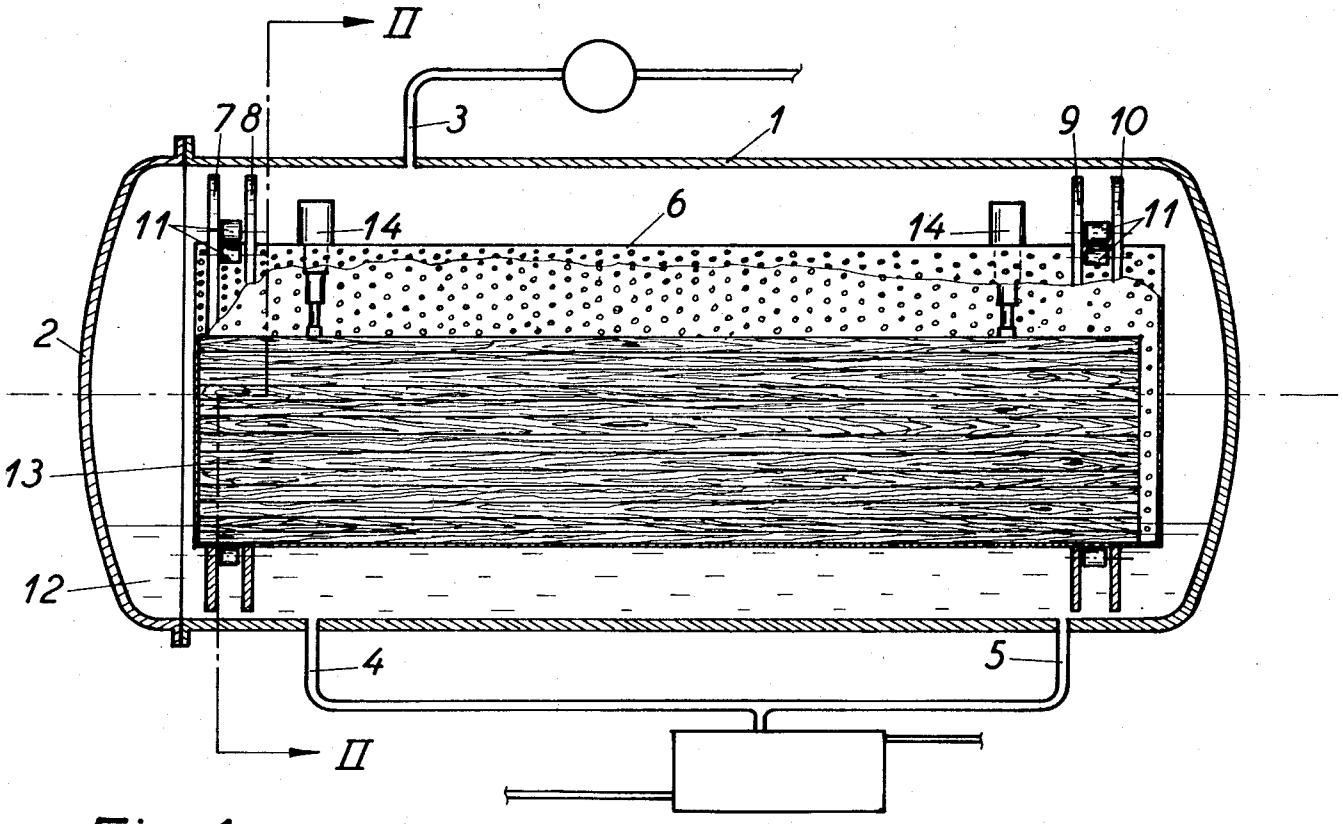

THIS IS A CONTINUATION-IN-PART APPLICATION OF U.S. APPLICATION SER. NO. 192,383 FILED MAY 2, 1980 NOW ABANDONED.

The present invention relates to a method for treating timber with liquid or liquid and vacuum or gas in a closed vessel, such as an autoclave.

Methods of this kind are normally carried out by placing the timber in a stationary closable vessel, such as an autoclave which is then closed in a fluid-tight manner, after which the treating liquid is introduced and allowed to remain in the vessel for a certain length of time. When the treating time has expired, the liquid is again removed from the vessel, and liquid still adhering to the timber is allowed to drain off. Finally the timber is removed from the vessel and either stored or transferred to other processing equipment, or transported away to a user.

One use of the method referred to above is for treating the timber with a liquid containing one or more dyes and/or pigments. This application gives rise to a problem, inasmuch as the dye and/or pigment will very often be unevenly distributed on the surfaces of the various pieces of the timber, due to these having remained stationary during the draining-off period, i.e. with the four sides facing in different directions and so causing the draining-off conditions to be different for the different sides of each piece of timber. One visible result of such uneven distribution may be the formation of stripes on some of the surfaces of the timber.

Another use of the method referred to above is for drying the timber by treatment with hot oil under vacuum. Although the hot oil is a very effective medium for transmitting the heat for drying to the timber, it also constitutes a barrier for the vapour formed by the evaporation of the moisture in the timber, if the timber is totally immersed.

Still another use of the method referred to above is for the impregnation of timber by using a treating liquid containing agents protecting the timber against moisture and/or attacs from insects, fungi etc.. In order to immerse timber totally in the liquid, it is necessary to fill the treating vessel almost to full total capacity, which of course makes it necessary to have large quantities of treating liquid available, as well as a correspondingly large container for storing the liquid at times when it is not placed in the treating vessel. As many impregnation agents are themselves coloured, the problems encountered in dyeing processes may also arise.

It is the object of the present invention to provide a method of the kind referred to in the opening paragraph above, with which it is possible to avoid the problems and disadvantages mentioned above.

The object stated is attained by means of a method, which according to the present invention is characterized in (a) that during at least part of the treatment, the timber is rotated several times about a non-vertical axis, preferably a horizontal axis, and (b) that during at least a part of the treatment coinciding with the part mentioned in paragraph a, the liquid content of the vessel is kept at a volume such that less than 100% of the timber is covered by the liquid, at least under a part of each rotation.

By proceeding in this manner, it is possible to treat all the timber in the batch without having to fill the treating vessel more or less completely with liquid. The most obvious effect is, of course, a substantial reduction in the amount of liquid which it is necessary to have available, as even with a very small partial filling of the treating vessel with liquid the liquid will be made to contact all sides of all timber pieces in the batch at some time or other as the rotation of the timber proceeds through a number of revolutions. Experience has shown that the liquid from timber pieces just lifted from the liquid bath will rum onto other pieces, even such as are not directly immersed at any time.

In the case of the method being used for treating the timber with dyeing and/or pigmenting liquid, the problem of the uneven distribution of the dye or pigment can be solved merely by continuing the rotation after the liquid has been removed from the vessel, so that the draining-off from the different sides of each piece of timber will proceed while the angle of inclination of each side changes continuously through 360 degrees, thus making the average drainage conditions equal or practically equal for all surfaces, consequently resulting in evenly dyed or pigmented surfaces.

In the case of the method being used for drying timber by treatment with hot oil under vacuum, the rotation of the timber will alternately place the timber below and above the surface of the oil, the volume of which only corresponds to a relatively small portion of the total capacity of the treating vessel. The effect of this is that the timber receives heat from the oil when below the surface, and evaporation can proceed unhindered when the timber is above the surface of the oil. At a particular instant, of course, some of the timber may be above the surface, whilst other parts of the same batch may be below it. In the situations where the liquid which is used by the present method is a hot oil it is beneficial to have the oil content of the vessel be held between one-quarter and one-half of the vessel's total capacity.

The invention also relates to a closable vessel for carrying out the method according to the invention and of the kind consisting of a prefarably cylindrical tank capable of sustaining pressure and/or vacuum and comprising at least one sealable door giving access to the interior of the tank and means for supplying liquid to and removing liquid from the tank as well as means, when needed, for applying gas pressure or vacuum to the interior of the tank, said method according to the invention being characterized by means within the tank for gripping and holding timber to be treated, said means being capable of being rotated about a non-vertical, preferably horizontal axis whilst holding said timber.

A first embodiment of said vessel is characterized in that said means for gripping and holding the timber consists of a box of rectangular or square cross section and capable of letting the treating liquid pass therethrough, said box having means for clamping the timber against one or more of its walls. The placing of the timber in such a box is especially advantageous, as the clamping of the timber is simplified. The treatment proceeds in an efficient and uniform manner, even if the timber is stacked closely and clamped with great force, as the individual pieces of timber will — in spite of the clamping — move relatively to each other during the rotation and thus allow the treating liquid to penetrate all the way into the middle of the stack of timber pieces, even in the case when some of the pieces of timber are never below the surface level of the liquid bath.

A second embodiment of the vessel, being of the kind, wherein said cylindrical tank is supported with its axis of rotational symmetry lying non-vertically, preferably horizontally, is according to the invention characterized in that the box is fitted with wheels so placed as to be capable of rolling on the inside wall of the tank when the box rotates therein. By in this manner using the inside wall of the cylindrical tank as a bearing surface, the need for seperate bearings and shafts for the box is avoided, and the construction of the vessel is considerably simplified. A further — and not least important — advantage is that access to the box is made easier than in the case of supporting the box on bearings and shafts placed at the axis of rotation.

A third embodiment of the vessel according to the invention is characterized in that the box is provided with a plurality of apertures or holes in its walls for passage of the treating liquid. The box should be provided with a sufficient number of apertures or holes of a sufficient size to allow the treating liquid to pass relatively unhindered into and out of the box.

Figure 2:
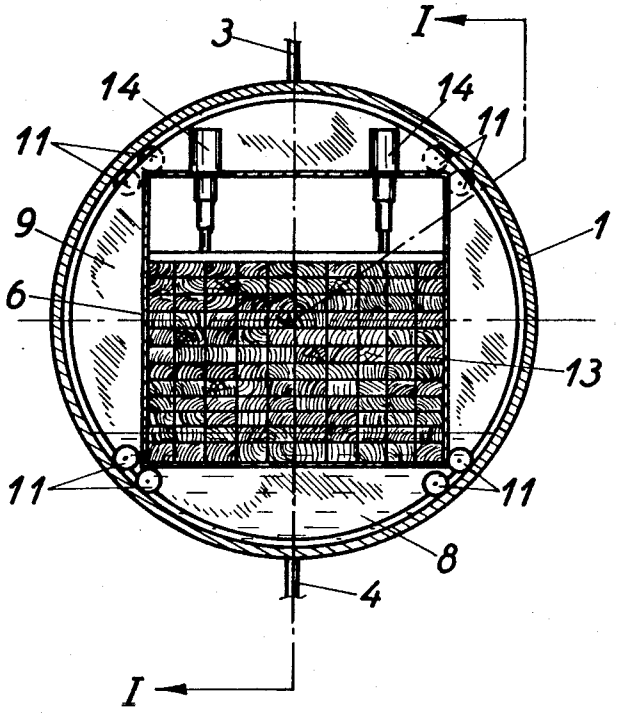

The invention will now be explained in greater detail with reference to accompanying drawings, in which FIG. 1 is a longitudinal axial section through a treating vessel according to the present invention, and FIG. 2 is a cross section along the line II—II in FIG. 1.

A cylindrical pressure vessel 1 is provided with an end closure or door 2, a filling tube 3 and draining tubes 4 and 5. A box 6 with square cross section is supported in two sets of plates or disks 7, 8 and 9, 10 with circular outer circumferences and with inner circumferences corresponding to the cross section af the box 6. The box is supported by small wheels 11, that rotate in bearings in the two sets of plates 7,8 and 9, 10. The wheels 11 are placed in pairs between the plates 7,8 and 9,10 respectively, and the angular distance between adjacent pairs of wheels is 90 degrees. When the box 6 is rotated, the wheels 11 roll against the inside wall of the pressure vessel 1. The box 6 is perforated to allow a treating liquid 12 to pass inwards and outwards. The timber 13 to be treated is placed in the box 6 and gripped and held therein by means of mechanical or hydraulic pistons i4. The vessel 1 is filled with treating liquid 12 so as to cover the lowermost part of the box 6 with liquid.

In the embodiment shown, the box 6 is made from perforated sheet material. It is, however, equally possible to make the box from a wire netting or grid, held in tension on or fastened to a frame.

I claim:

1. A method for treatment of a timber in an enclosed vessel capable of sustaining pressure and/or vaccuum, which comprises sequentially:

(a) placing the timber inside of the enclosed vessel;

(b) rotating of said timber inside of said enclosed vessel containing a liquid, about a non-vertical axis of said vessel for at least several full revolutions in a such manner that the liquid content of said vessel is kept at a volume covering less than 100 percent of said timber at least during a part of each rotation;

(c) removing said liquid from said vessel;

(d) draining of said timber inside of said vessel by continuous rotating of said timber inside of said enclosed vessel about non-vertical axis of said vessel;

(e) removing said timber from said chamber.

2. A method according to claim 1, wherein the timber is treated with the liquid and a gas.

3. A method according to claim 1, wherein the timber is treated with the liquid in a vacuum.

4. A method according to claim 1, wherein the enclosed vessel is an autoclave.

5. A method according to claims 1, 3 or 4, wherein the liquid is a hot oil and the oil content of the vessel is held between one-quarter and one-half of the vessel's to total capacity.

6. A method according to claims 1, 2, 3 or 4, wherein the treating liquid contains agents protecting the timber against moisture and attacks from insects and fungi.

* * * * *